US010706757B2

(12) United States Patent
Chun et al.

(10) Patent No.: US 10,706,757 B2
(45) Date of Patent: Jul. 7, 2020

(54) IMAGE CORRECTION UNIT, DISPLAY DEVICE INCLUDING THE SAME, AND METHOD OF DISPLAYING IMAGE OF THE DISPLAY DEVICE

(71) Applicant: SAMSUNG DISPLAY CO., LTD., Yongin-si, Gyeonggi-do (KR)

(72) Inventors: Byung Ki Chun, Yongin-si (KR); Jin Woo Noh, Yongin-si (KR); Jun Gyu Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 293 days.

(21) Appl. No.: 15/137,773

(22) Filed: Apr. 25, 2016

(65) Prior Publication Data

US 2016/0321974 A1 Nov. 3, 2016

(30) Foreign Application Priority Data

Apr. 30, 2015 (KR) ..... 10-2015-0061855

(51) Int. Cl.
*G09G 3/20* (2006.01)
*G09G 3/00* (2006.01)

(52) U.S. Cl.
CPC ..... *G09G 3/007* (2013.01); *G09G 3/20* (2013.01); *G09G 2320/0295* (2013.01); *G09G 2320/043* (2013.01); *G09G 2320/046* (2013.01); *G09G 2320/0686* (2013.01); *G09G 2340/04* (2013.01); *G09G 2340/045* (2013.01); *G09G 2340/0407* (2013.01); *G09G 2340/0414* (2013.01); *G09G 2340/0421* (2013.01); *G09G 2340/0464* (2013.01); *G09G 2340/0471* (2013.01); *G09G 2340/0478* (2013.01)

(58) Field of Classification Search
None
See application file for complete search history.

(56) References Cited

U.S. PATENT DOCUMENTS

| | | | |
|---|---|---|---|
| 6,747,671 | B1 | 6/2004 | Saito |
| 8,873,101 | B2 | 10/2014 | Tamura |
| 2001/0035874 | A1 | 11/2001 | Hamilton et al. |
| 2003/0122853 | A1 | 7/2003 | Kim |

(Continued)

FOREIGN PATENT DOCUMENTS

| | | | |
|---|---|---|---|
| CN | 1577436 | A | 2/2005 |
| CN | 101064769 | A | 10/2007 |

(Continued)

OTHER PUBLICATIONS

EPO Extended Search Report dated Sep. 6, 2016, for corresponding European Patent Application No. 16167800.8 (16 pages).

(Continued)

*Primary Examiner* — William Boddie
*Assistant Examiner* — Jeffrey Parker
(74) *Attorney, Agent, or Firm* — Lewis Roca Rothgerber Christie LLP

(57) ABSTRACT

There is provided a method of displaying an image on a display device, the method including moving an image displayed at an image display region of the display device, and reducing a first region and enlarging a second region, the first and second regions included in the image, wherein the image has a smaller size than the image display region.

26 Claims, 12 Drawing Sheets

(56) References Cited

U.S. PATENT DOCUMENTS

| | | | | |
|---|---|---|---|---|
| 2007/0109284 | A1 | 5/2007 | Yamazaki et al. | |
| 2009/0251483 | A1* | 10/2009 | Hsu | G09G 3/2055 345/589 |
| 2010/0149218 | A1 | 6/2010 | Betts-LaCroix | |
| 2014/0192090 | A1* | 7/2014 | Park | G06F 3/0481 345/672 |
| 2014/0281607 | A1 | 9/2014 | Tse | |
| 2015/0091908 | A1* | 4/2015 | Kawatani | G06F 17/5004 345/428 |
| 2016/0179269 | A1 | 6/2016 | Chun et al. | |
| 2016/0320916 | A1 | 11/2016 | Chun et al. | |

FOREIGN PATENT DOCUMENTS

| | | | |
|---|---|---|---|
| CN | 101877214 | A | 11/2010 |
| EP | 1503360 | A2 | 2/2005 |
| JP | 2000-227775 | A | 8/2000 |
| JP | 2000-338947 | A | 12/2000 |
| JP | 2003-177715 | A | 6/2003 |
| JP | 2004-333751 | A | 11/2004 |
| JP | 2005-31369 | A | 2/2005 |
| JP | 2007-72455 | A | 3/2007 |
| JP | 10-2007-0048852 | A | 5/2007 |
| JP | 2012-121165 | A | 6/2012 |
| KR | 10-2004-0026059 | A | 3/2004 |
| KR | 10-2007-0048852 | A | 5/2007 |
| KR | 10-2016-0129983 | | 11/2016 |

OTHER PUBLICATIONS

Japanese Office Action, with English machine translation, dated Nov. 26, 2019, for corresponding Japanese Patent Application No. 2016-002385 (8 pages).

Chinese Office Action, with English machine translation, dated Dec. 31, 2019, for corresponding Chinese Patent Application No. 201610285758.3 (12 pages).

* cited by examiner

FIG. 8

LUT1

| Fi | [(SDx)SQx , (SDy)SQy] |
|---|---|
| 10 | [(−)1 , 0] |
| 20 | [(−)1 , (+)1] |
| 30 | [ 0 , (+)1] |
| 40 | [(+)1 , (+)1] |
| 50 | [(+)1 , 0 ] |
| ⋮ | ⋮ |

FIG. 9

LUT2

| Fi | WBx |
|---|---|
| 10 | 1 |
| 20 | 2 |
| 30 | 3 |
| 40 | 4 |
| 50 | 5 |
| ⋮ | ⋮ |

IMAGE CORRECTION UNIT, DISPLAY DEVICE INCLUDING THE SAME, AND METHOD OF DISPLAYING IMAGE OF THE DISPLAY DEVICE

CROSS-REFERENCE TO RELATED APPLICATION

This application claims priority to and the benefit of Korean Patent Application No. 10-2015-0061855, filed on Apr. 30, 2015, in the Korean Intellectual Property Office, the entire content of which is incorporated herein by reference in its entirety.

BACKGROUND

1. Field

Aspects of embodiments of the present invention relate to an image correction unit, a display device including the same, and a method of displaying an image of the display device.

2. Description of the Related Art

Recently, various display devices such as organic light emitting display devices (OLEDs), liquid crystal display devices (LCDs), and plasma display devices are widely used.

In the above-described display devices, as driving time increases, a specific pixel may deteriorate, which may cause the performance of the display device to also deteriorate.

For example, because a digital information display device used for transmitting information in a public place and a vehicle continuously outputs a specific image or character for a long time, deterioration of specific pixels may be accelerated such that an afterimage may be generated.

SUMMARY

In order to solve the above problem, technology (e.g., pixel shift technology) of moving an image on a display panel in a uniform period and displaying the moved image is used. When the image moves on the display panel in the uniform period and is displayed, it is possible to prevent the same data from being output to a specific pixel for a long time and to prevent the specific pixel from deteriorating.

Aspects of embodiments of the present invention are directed toward an image correction unit capable of effectively preventing an afterimage from being generated or reducing the incidence thereof, a display device including the same, and a method of displaying an image of the display device.

According to some embodiments of the present invention, there is provided a method of displaying an image on a display device, the method including: moving an image displayed at an image display region of the display device, and reducing a first region and enlarging a second region, the first and second regions included in the image, wherein the image has a smaller size than the image display region.

In an embodiment, in the image display region, a remaining region excluding the region on which the image is displayed displays black.

In an embodiment, the image further includes a third region between the first region and the second region, and the third region of the image moves in a direction in which the first region is reduced.

In an embodiment, a size of the image is maintained to be the same before and after the image moves.

In an embodiment, the second region of the image is enlarged by as much as the first region of the image is reduced.

According to some embodiments of the present invention, there is provided an image correction unit including: a movement amount determiner configured to determine an X axis movement direction and an X axis movement amount; an X axis shift determiner configured to determine an X axis black data amount; an X axis area setting unit configured to set a first X axis area and a second X axis area each including a plurality of sub-areas such that the sub-areas of the first X axis area correspond to those of the second X axis area by using the X axis movement amount, the X axis black data amount, an X axis image scaling ratio, and an X axis internal scaling ratio; and an X axis data calculating unit configured to calculate pixel data of second image data in each of the sub-areas of the second X axis area by using pixel data of first image data in each of the sub-areas of the first X axis area.

In an embodiment, the second image data includes at least a column of black pixel data at an edge thereof.

In an embodiment, the first X axis area includes a first sub-area, a third sub-area, and a second sub-area between the first sub-area and the third sub-area, and each of the first sub-area, the second sub-area, and the third sub-area of the first X axis area includes a plurality of fine areas.

In an embodiment, the X axis data calculating unit is configured to calculate pixel data of second image data corresponding to a fine area of the first X axis area by using at least one pixel data in the fine area of the first X axis area.

In an embodiment, the X axis data calculating unit is configured to calculate pixel data of second image data corresponding to a fine area of the first X axis area with reference to a ratio corresponding to at least one pixel data in the fine area of the first X axis area.

In an embodiment, the movement amount determiner is further configured to determine a Y axis movement direction and a Y axis movement amount.

In an embodiment, the image correction unit further includes: a Y axis shift determiner configured to determine a Y axis black data amount; a Y axis area setting unit configured to set a first Y axis area and a second Y axis area by using the Y axis movement amount, the Y axis black data amount, a Y axis image scaling ratio, and a Y axis internal scaling ratio, each of the first and second Y axis areas including a plurality of sub-areas such that the sub-areas of the first Y axis area correspond to those of the second Y axis area; and a Y axis data calculating unit configured to calculate pixel data of third image data in each of the sub-areas of the second Y axis area by using pixel data of the second image data in each of the sub-areas of the first Y axis area.

In an embodiment, the third image data includes at least a row of black pixel data at an edge thereof.

In an embodiment, the first Y axis area includes a first sub-area, a third sub-area, and a second sub-area between the first sub-area and the third sub-area, and each of the first sub-area, the second sub-area, and the third sub-area of the first Y axis area includes a plurality of fine areas.

In an embodiment, the Y axis data calculating unit is configured to calculate pixel data of third image data corresponding to a fine area of the first Y axis area by using at least one pixel data in the fine area of the first Y axis area.

In an embodiment, the Y axis data calculating unit is further configured to calculate pixel data of third image data corresponding to a fine area of the first Y axis area with reference to a ratio corresponding to at least one pixel data in the fine area of the first Y axis area.

According to some embodiments of the present invention, there is provided a display device including: a display panel; an image correction unit configured to correct first image data; and a display driver configured to control the display panel such that an image corresponding to image data corrected by the image correction unit is displayed on the display panel by using the corrected image data, wherein the image correction unit includes: a movement amount determiner configured to determine an X axis movement direction and an X axis movement amount; an X axis shift determiner configured to determine an X axis black data amount; an X axis area setting unit configured to set a first X axis area and a second X axis area each including a plurality of sub-areas such that the sub-areas of the first X axis area correspond to those of the second X axis area by using the X axis movement amount, the X axis black data amount, an X axis image scaling ratio, and an X axis internal scaling ratio; and an X axis data calculating unit configured to calculate pixel data of second image data in each of the sub-areas of the second X axis area by using pixel data of the first image data in each of the sub-areas of the first X axis area.

In an embodiment, the second image data includes at least a column of black pixel data at an edge thereof.

In an embodiment, the first X axis area includes a first sub-area, a third sub-area, and a second sub-area between the first sub-area and the third sub-area, and each of the first sub-area, the second sub-area, and the third sub-area of the first X axis area includes a plurality of fine areas.

In an embodiment, the X axis data calculating unit is configured to calculate pixel data of second image data corresponding to a fine area of the first X axis area by using at least one pixel data in the fine area of the first X axis area.

In an embodiment, the X axis data calculating unit is configured to calculate pixel data of second image data corresponding to a fine area of the first X axis area with reference to a ratio corresponding to at least one pixel data in the fine area of the first X axis area.

In an embodiment, the movement amount determiner is further configured to determine a Y axis movement direction and a Y axis movement amount.

In an embodiment, the display device further includes: a Y axis shift determiner configured to determine a Y axis black data amount; a Y axis area setting unit configured to set a first Y axis area and a second Y axis area each including a plurality of sub-areas such that the sub-areas of the first Y axis area correspond to those of the second Y axis area by using the Y axis movement amount, the Y axis black data amount, a Y axis image scaling ratio, and a Y axis internal scaling ratio; and a Y axis data calculating unit configured to calculate pixel data of third image data in each of the sub-areas of the second Y axis area by using pixel data of the second image data in each of the sub-areas of the first Y axis area.

In an embodiment, the third image data includes at least a row of black pixel data at an edge thereof.

In an embodiment, the first Y axis area includes a first sub-area, a third sub-area, and a second sub-area between the first sub-area and the third sub-area, and each of the first sub-area, the second sub-area, and the third sub-area of the first Y axis area includes a plurality of fine areas.

In an embodiment, the Y axis data calculating unit is configured to calculate pixel data of third image data corresponding to a fine area of the first Y axis area by using at least one pixel data in the fine area of the first Y axis area.

In an embodiment, the Y axis data calculating unit is configured to calculate pixel data of third image data corresponding to a fine area of the first Y axis area with reference to a ratio corresponding to at least one pixel data in the fine area of the first Y axis area.

As described above, according to embodiments of the present invention, it is possible to provide the image correction unit capable of effectively preventing an afterimage from being generated or reducing the incidence thereof, the display device including the same, and the method of displaying an image of the display device.

BRIEF DESCRIPTION OF THE DRAWINGS

Example embodiments will now be described more fully hereinafter with reference to the accompanying drawings; however, the disclosure may be embodied in different forms and should not be construed as limited to the embodiments set forth herein. Rather, these embodiments are provided so that this disclosure will be thorough and complete, and will full convey the scope of the example embodiments to those skilled in the art.

In the figures, dimensions may be exaggerated for clarity of illustration. Like reference numerals refer to like elements throughout.

FIG. 8 illustrates a first look-up table according to an embodiment of the present invention;

FIG. 9 illustrates a second look-up table according to an embodiment of the present invention;

DETAILED DESCRIPTION

Figure 1:
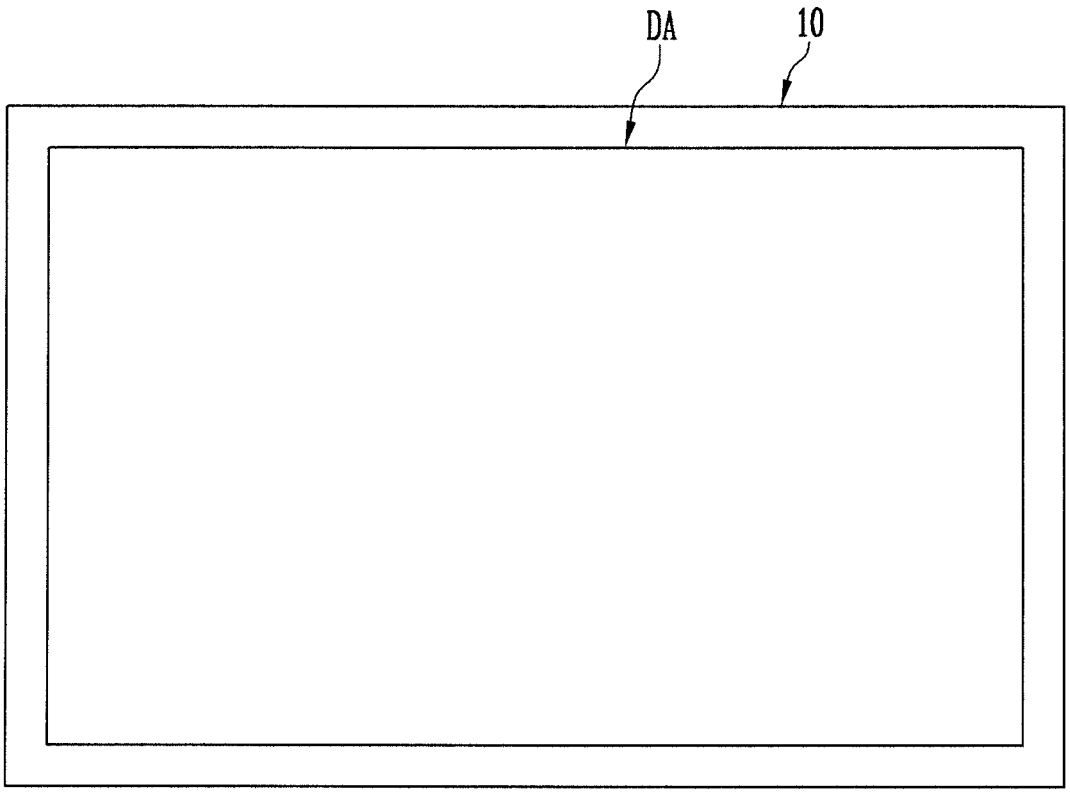
FIG. 1 is a view illustrating an image display region of a display device according to an embodiment of the present invention.

Embodiments of the present invention will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art. Like reference numerals refer to like elements throughout.

Hereinafter, an image correction unit (or an image corrector) according to embodiments of the present invention, a display device including the same, and a method of displaying an image of the display device will be described with reference to the accompanying drawings.

FIG. 1 is a view illustrating an image display region of a display device 10 according to an embodiment of the present invention.

Referring to FIG. 1, the display device 10 according to an embodiment of the present invention may include an image display region DA capable of displaying an image.

The display device 10 for providing an image (e.g., a predetermined image) to a user may display an image on the image display region DA.

The user of the display device 10 may recognize the image displayed on the image display region DA.

For example, the display device 10 may be implemented by a television, a monitor, a mobile device, and a navigation device.

FIGS. 2A to 4B are views illustrating a method of displaying an image of a display device according to an embodiment of the present invention.

Referring to FIGS. 2A to 4B, the method of displaying an image of the display device according to the embodiment of the present invention will be described.

Figure 2A:
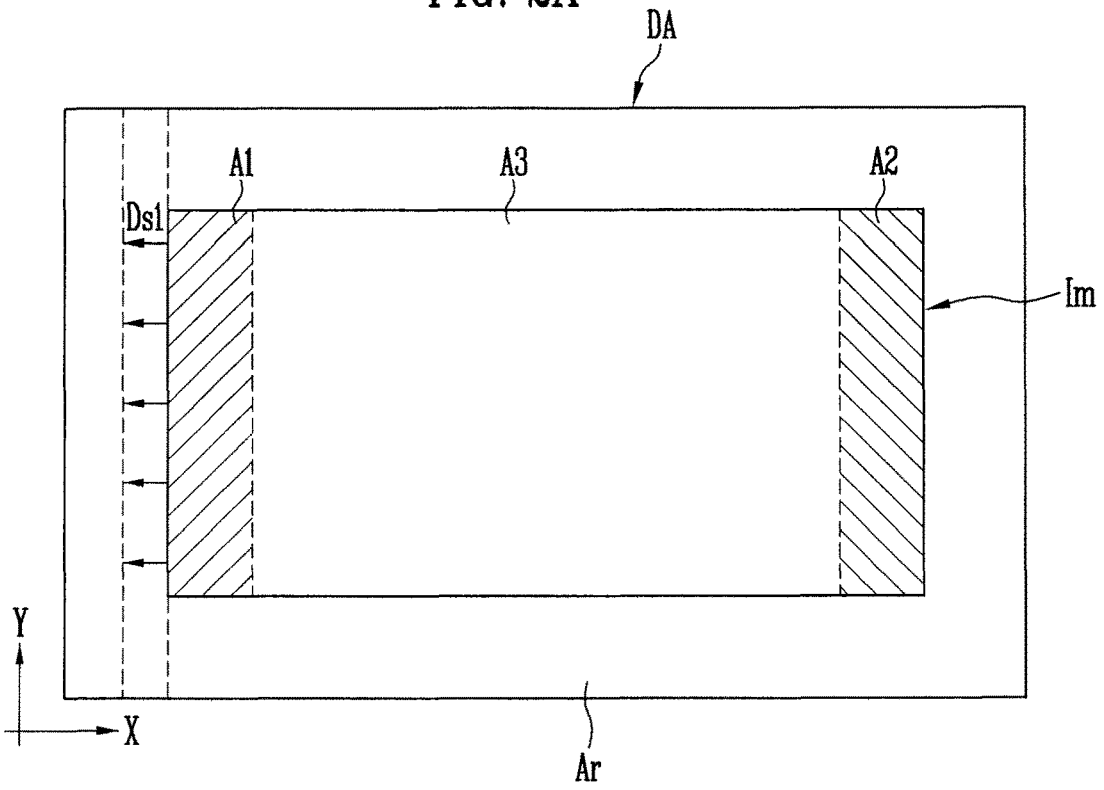
FIGS. 2A-4B are views illustrating a method of displaying an image of a display device according to an embodiment of the present invention.
Figure 2B:
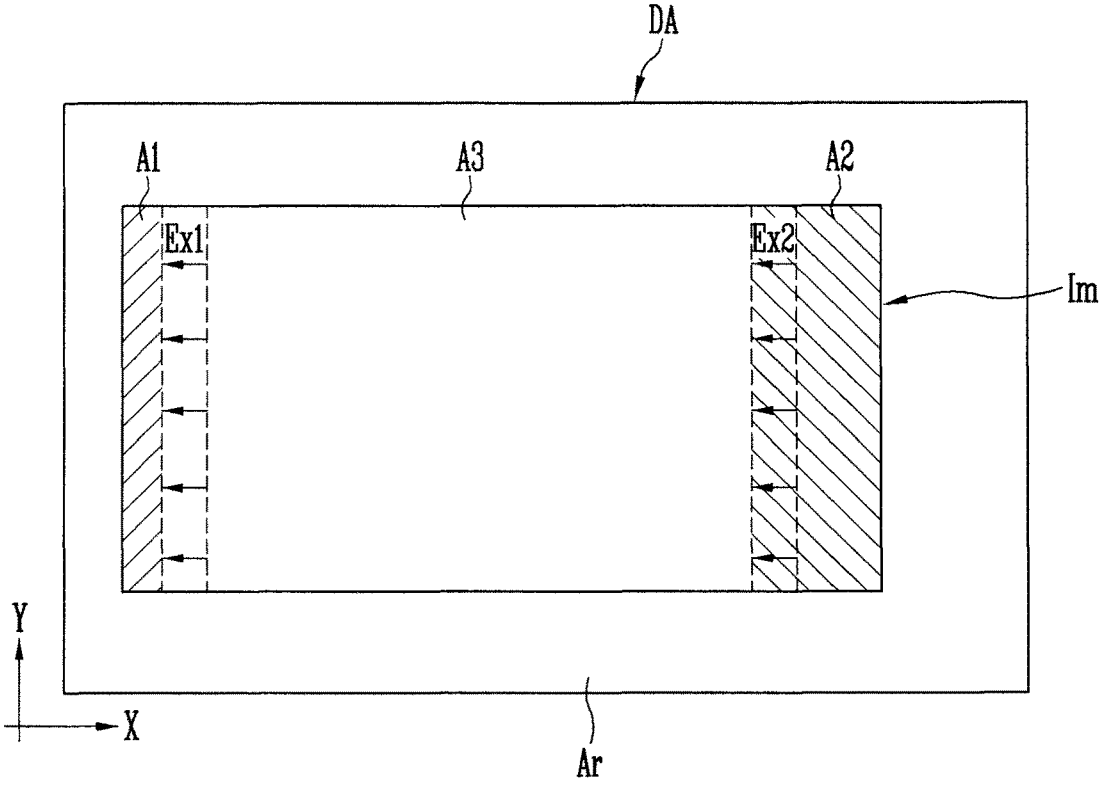

In particular, FIGS. 2A and 2B illustrate that an image moves in an X axis direction.

Referring to FIG. 2A, in an nth period (where n is a natural number of no less than 1), an image (e.g., a predetermined image) Im may be displayed on the image display region DA.

At this time, a size of the image Im may be set to be smaller than the image display region DA.

In addition, in the image display region DA, a remaining region Ar excluding a region on which the image Im is displayed may display black.

For example, because the region Ar on which the image Im is not displayed maintains a non-emission state, the region Ar may look black to a user.

The image Im may include a plurality of regions. For example, the image Im may include a first region A1, a second region A2, and a third region A3.

The third region A3 may be positioned between the first region A1 and the second region A2.

In addition, the first region A1 is positioned on the left of the third region A3 and the second region A2 may be positioned on the right of the third region A3.

In the method of displaying an image of the display device according to the embodiment of the present invention, the image Im may be displayed while moving and partial regions included in the image Im may be reduced and enlarged.

For example, the image Im is displayed in a specific position of the image display region DA in the nth period (e.g., refer to FIG. 2A) and may be displayed in a state of being moved in a specific direction (e.g., in the X axis direction) in an (n+m)th period (where m is a natural number of no less than 1).

That is, as illustrated in FIG. 2A, the image Im may move in a −X direction (e.g., to the left) by a specific distance Ds1.

In addition, the image Im may move in a +X direction (e.g., to the right).

In addition, the first region A1 and the second region A2 of the image Im have a preset or predetermined area in the nth period (e.g., refer to FIG. 2A) and an area of the first region A1 is reduced and an area of the second region A2 may be enlarged in the (n+m)th period (e.g., refer to FIG. 2B).

That is, as illustrated in FIG. 2B, the area of the first region A1 may be reduced by Ex1 and the area of the second region A2 may be enlarged by Ex2.

At this time, the second region A2 may be enlarged by as much as the first region A1 is reduced. For example, the area change amount Ex1 of the first region A1 may be equal to the area change amount Ex2 of the second region A2.

Therefore, the image Im displayed according to the embodiment of the present invention may move in a specific direction while maintaining a size thereof.

That is, the size of the image Im displayed according to the embodiment of the present invention may be maintained to be the same or substantially the same before and after the image Im moves.

The third region A3 positioned between the first region A1 and the second region A2 may move in a direction in which the first region A1 is reduced.

That is, as illustrated in FIG. 2B, the third region A3 may move in the direction (e.g., to the left) in which the first region A1 is reduced.

At this time, the third region A3 is not reduced or enlarged and may maintain a size thereof.

In FIGS. 2A and 2B, a region positioned on the left of the image Im is referred to as the first region A1 and a region positioned on the right of the image Im is referred to as the second region A2. However, the first region A1 and the second region A2 may be exchanged.

For example, the region positioned on the right of the image Im may be set as the first region A1 and the region positioned on the left of the image Im may be set as the second region A2.

It is possible to prevent an afterimage from being generated or reducing the incidence thereof by moving the image Im as described above. At the same time, it is possible to efficiently prevent the afterimage from being generated or reducing the incidence thereof by concurrently (e.g., simultaneously) reducing and enlarging the internal regions A1 and A2 of the image Im, respectively.

That is, because a central region of the image display region DA more frequently displays an image than an edge region thereof, it is possible to prevent the afterimage from being generated in the central region of the image display region DA or reducing the incidence thereof by reducing, enlarging, and moving the internal regions A1, A2, and A3 of the image Im.

Figure 3A:
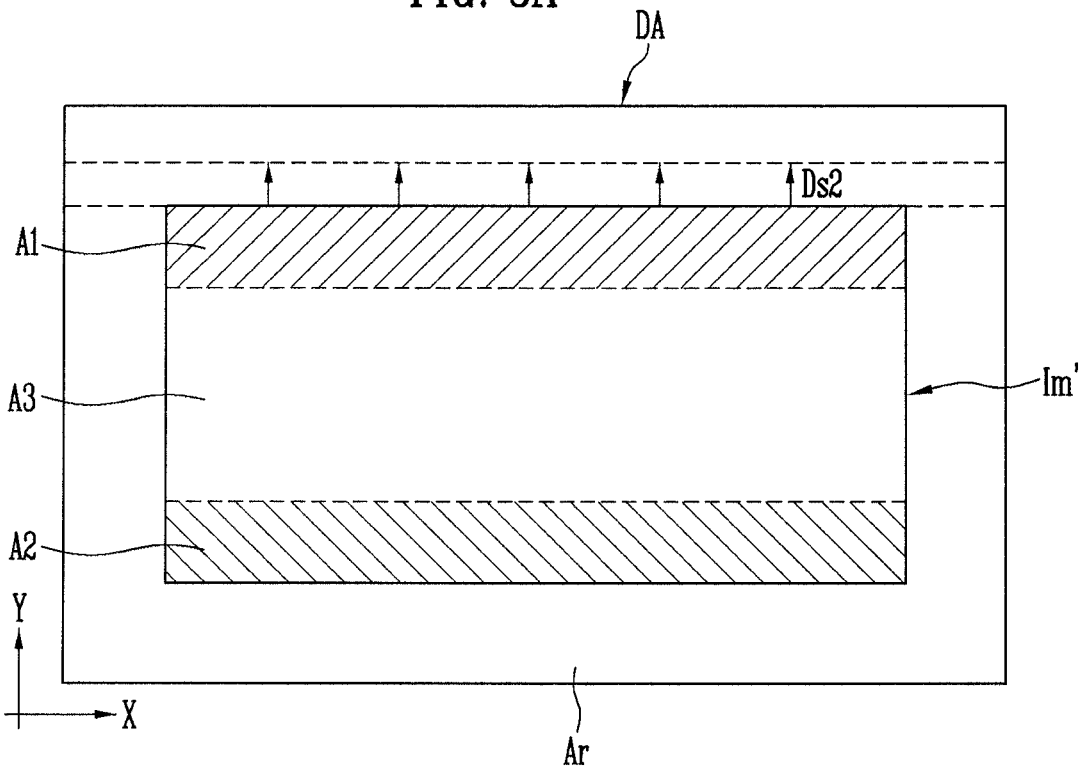
Figure 3B:
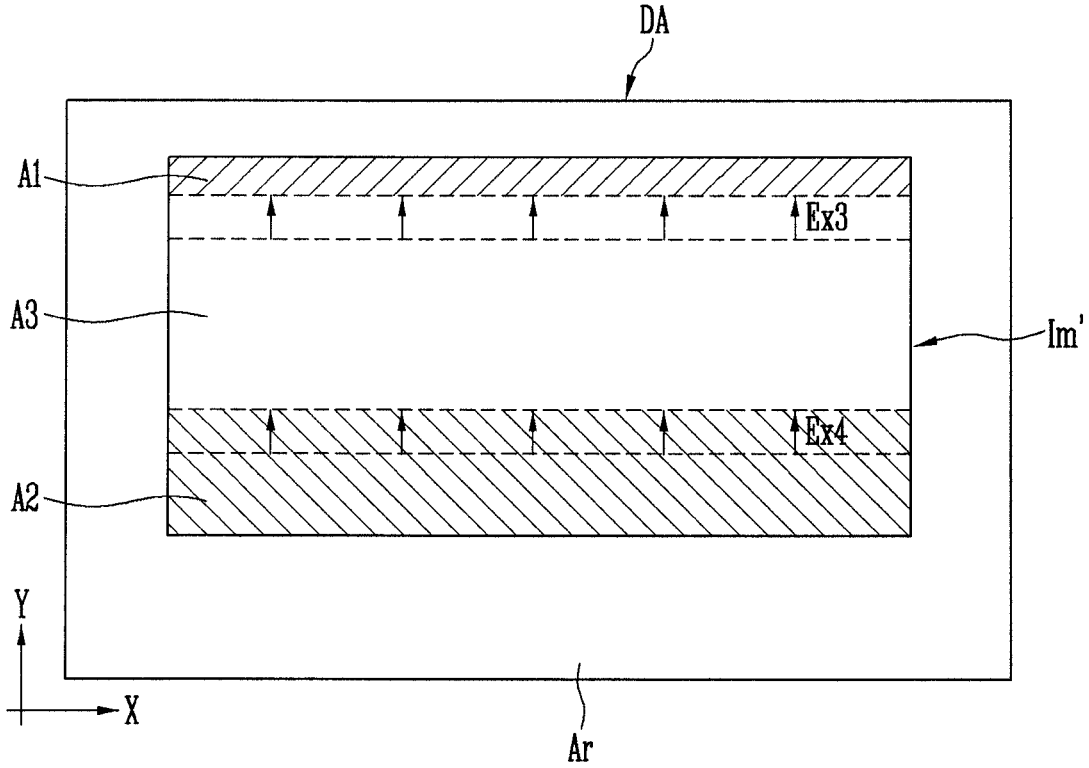

In particular, FIGS. 3A and 3B illustrate that an image moves in a Y axis direction.

Hereinafter, description of contents substantially similar to those of the embodiment of FIGS. 2A and 2B may not be repeated.

Referring to FIG. 3A, an image (e.g., a predetermined image) Im' may be displayed in the image display region DA in the nth period.

At this time, the image Im' may include a plurality of regions. For example, the image Im' may include a first region A1, a second region A2, and a third region A3.

The third region A3 may be positioned between the first region A1 and the second region A2.

In addition, the first region A1 may be positioned on the third region A3 and the second region A2 may be positioned under the third region A3.

For example, the image Im' is displayed in a specific position of the image display region DA in the nth period (e.g., refer to FIG. 3A) and may be displayed in a state of being moved in a specific direction (in the Y axis direction) in the (n+m)th period (e.g., refer to FIG. 3B).

That is, as illustrated in FIG. 3A, the image Im' may move in a +Y direction (e.g., to an upper side) by a specific distance Ds2.

In addition, the image Im' may move in a −Y direction (e.g., to a lower side).

In addition, the first region A1 and the second region A2 of the image Im' have a preset or predetermined area in the nth period (e.g., refer to FIG. 3A) and an area of the first region A1 is reduced and an area of the second region A2 may be enlarged in the (n+m)th period (e.g., refer to FIG. 3B).

That is, as illustrated in FIG. 3B, the area of the first region A1 may be reduced by Ex3 and the area of the second region A2 may be enlarged by Ex4.

At this time, the second region A2 may be enlarged by as much as the first region A1 is reduced. For example, the area change amount Ex3 of the first region A1 may be equal to the area change amount Ex4 of the second region A2.

The third region A3 positioned between the first region A1 and the second region A2 may move in a direction in which the first region A1 is reduced.

That is, as illustrated in FIG. 3B, the third region A3 may move in the direction (e.g., to the upper side) in which the first region A1 is reduced.

At this time, the third region A3 is not reduced or enlarged and may maintain a size thereof.

In FIGS. 3A and 3B, a region positioned on the image Im' is referred to as the first region A1 and a region positioned under the image Im' is referred to as the second region A2. However, the first region A1 and the second region A2 may be exchanged.

For example, the region positioned under the image Im' may be set as the first region A1 and the region positioned on the image Im' may be set as the second region A2.

Figure 4A:
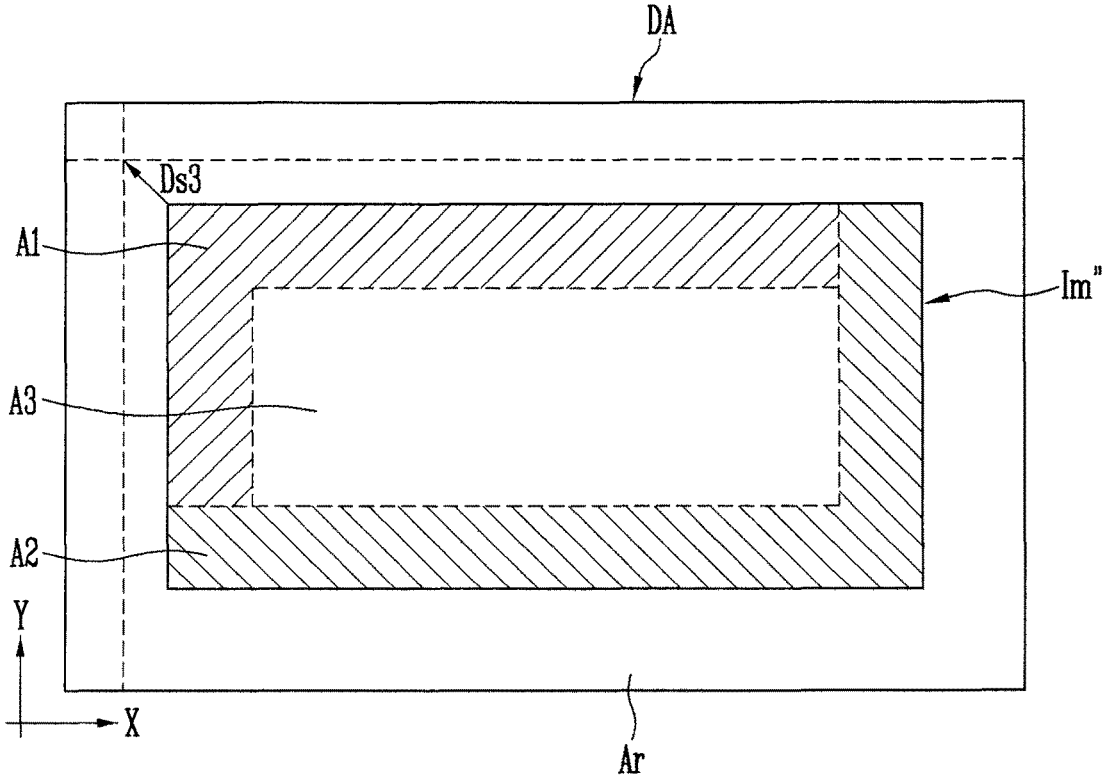
Figure 4B:
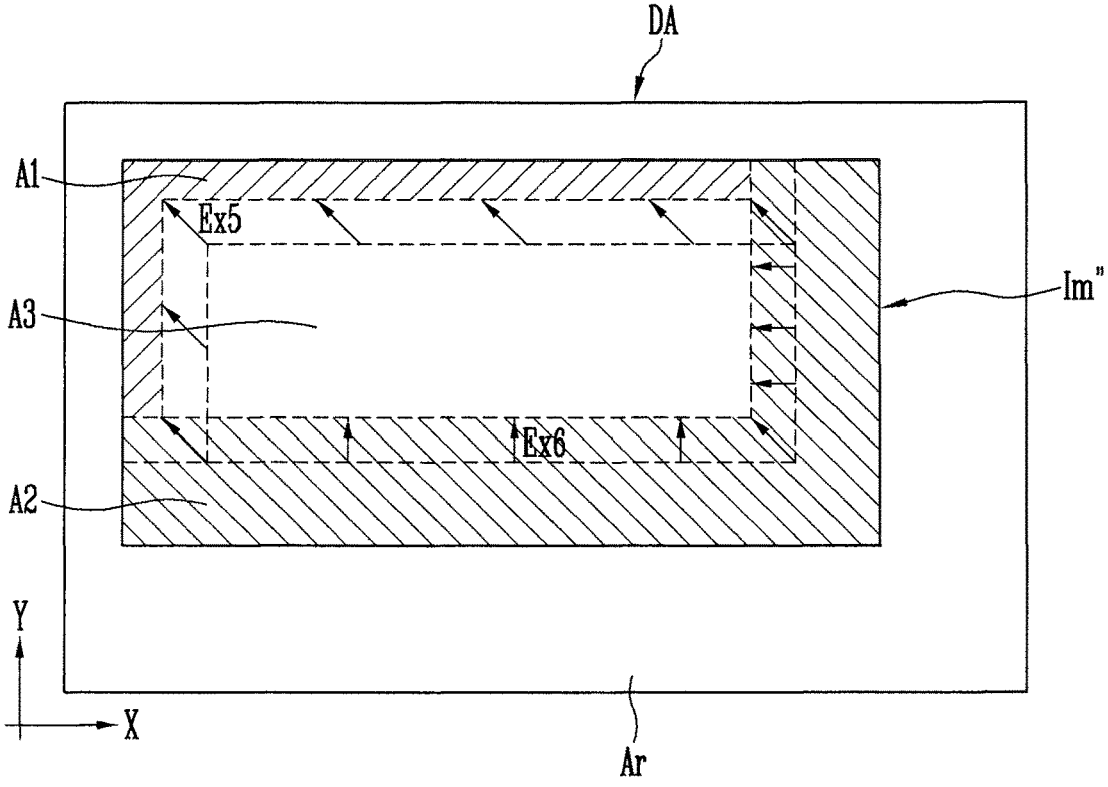

In particular, FIGS. 4A and 4B illustrate that an image moves in a diagonal direction.

Hereinafter, description of contents substantially similar to those of the embodiment of FIGS. 2A and 2B may not be repeated.

Referring to FIG. 4A, an image (e.g., a predetermined image) Im" may be displayed in the image display region DA in the nth period.

At this time, the image Im" may include a plurality of regions. For example, the image Im" may include a first region A1, a second region A2, and a third region A3.

The third region A3 may be positioned between the first region A1 and the second region A2.

In addition, the first region A1 is positioned on the left and on the third region A3 and the second region A2 may be positioned on the right and under the third region A3.

For example, the image Im" is displayed in a specific position of the image display region DA in the nth period (e.g., refer to FIG. 4A) and may be displayed in a state of being moved in a specific direction (e.g., in a diagonal direction) in the (n+m)th period (e.g., refer to FIG. 4B).

That is, as illustrated in FIG. 4A, the image Im" may move in the diagonal direction (e.g., to the left upper side) by a specific distance Ds3.

In addition, the image Im" may move in another diagonal direction.

In addition, the first region A1 and the second region A2 of the image Im" may have a preset or predetermined area in the nth period (e.g., refer to FIG. 4A) and an area of the first region A1 is reduced and an area of the second region A2 may be enlarged in the (n+m)th period (e.g., refer to FIG. 4B).

That is, as illustrated in FIG. 4B, the area of the first region A1 may be reduced by Ex5 and the area of the second region A2 may be enlarged by Ex6.

At this time, the second region A2 may be enlarged by as much as the first region A1 is reduced. For example, the area change amount Ex5 of the first region A1 may be equal to the area change amount Ex6 of the second region A2.

The third region A3 positioned between the first region A1 and the second region A2 may move in a direction in which the first region A1 is reduced.

That is, as illustrated in FIG. 4B, the third region A3 may move in the direction (in the left upper diagonal direction) in which the first region A1 is reduced.

At this time, the third region A3 is not reduced or enlarged and may maintain a size thereof.

In FIGS. 4A and 4B, a region positioned on the left and on the image Im" is referred to as the first region A1 and a region positioned on the right and under the image Im" is referred to as the second region A2. However, the first region A1 and the second region A2 may be variously positioned in a suitable manner.

Figure 5:
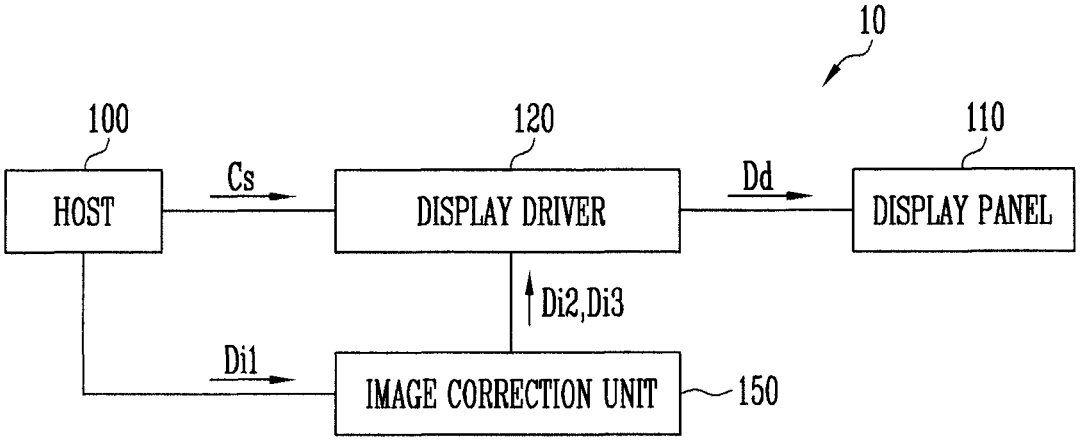
FIG. 5 is a block diagram illustrating the display device according to the embodiment of the present invention.

FIG. 5 is a block diagram illustrating the display device 10 according to the embodiment of the present invention.

Referring to FIG. 5, the display device 10 according to the embodiment of the present invention may include a host 100, a display panel 110, a display driver 120, and an image correction unit 150.

The host 100 may supply first image data Di1 to the image correction unit 150.

In addition, the host 100 may supply the first image data Di1 to the display driver 120.

The host 100 may supply a control signal Cs to the display driver 120.

The control signal Cs may include a vertical synchronization signal, a horizontal synchronization signal, a data enable signal, and a clock signal.

In addition, in some examples, the host 100 may supply the control signal Cs to the image correction unit 150.

For example, the host 100 may include a processor, a graphic processing unit (or a graphic processor), and a memory.

The display panel 110 includes a plurality of pixels and may display an image (e.g., a predetermined image). For example, the display panel 110 may display an image in accordance with a control signal from the display driver 120.

In addition, the display panel 110 may be implemented in an organic light emitting display panel, a liquid crystal display panel, and a plasma display panel. However, the present invention is not limited thereto.

Hereinafter, referring to FIG. 6, the display panel 110 will be described in more detail.

The display driver 120 supplies a driving signal Dd to the display panel 110 and may control an image display operation of the display panel 110.

For example, the display driver 120 may generate the driving signal Dd by using image data items Di1, Di2, and Di3 and the control signal Cs supplied from the outside.

For example, the display driver 120 receives the corrected image data Di2 and Di3 from the image correction unit 150 and may display the image illustrated in FIGS. 2A to 4B on the display panel 110 by using the corrected image data Di2 and Di3.

In addition, when an operation of the image correction unit 150 stops, the display driver 120 receives the first image data Di1 from the host 100 instead of the second image data Di2 and third image data Di3 of the image correction unit 150 and may display an image to which a pixel shift function is not applied by using the first image data Di1.

Hereinafter, referring to FIG. 6, the display driver 120 will be described in more detail.

The image correction unit 150 may correct the first image data Di1 supplied from the outside.

For example, the image correction unit 150 may generate the second image data Di2 and the third image data Di3 by using the first image data Di1.

In addition, the image correction unit 150 may supply the second image data Di2 and the third image data Di3 to the display driver 120.

At this time, the image correction unit 150 may receive the first image data Di1 from the host 100.

As illustrated in FIG. 5, the image correction unit 150 may be separated from (e.g., external to) the display driver 120.

In another embodiment, the image correction unit 150 may be integrated with the display driver 120 or the host 100.

Figure 6:
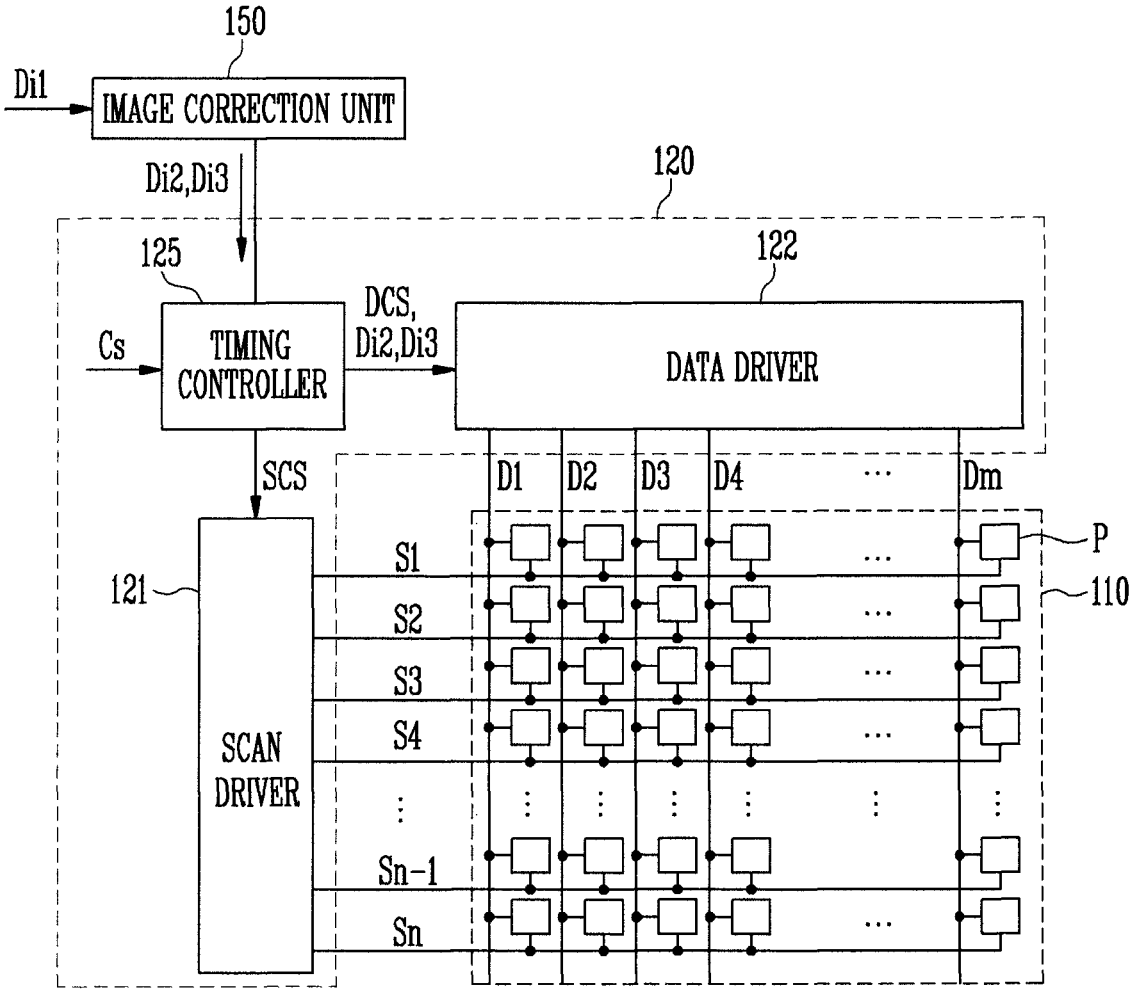
FIG. 6 is a block diagram illustrating the display panel, the display driver, and the image correction unit according to the embodiment of the present invention.

FIG. 6 is a block diagram illustrating the display panel 110, the display driver 120, and the image correction unit 150 according to the embodiment of the present invention.

Referring to FIG. 6, the display panel 110 according to the embodiment of the present invention may include a plurality of data lines D1 to Dm, a plurality of scan lines S1 to Sn, and a plurality of pixels P.

The pixels P may be connected to the data lines D1 to Dm and the scan lines S1 to Sn. For example, the pixels P may be arranged at crossing regions of the data lines D1 to Dm and the scan lines S1 to Sn in a matrix.

In addition, the pixels P may receive data signals and scan signals through the data lines D1 to Dm and the scan lines S1 to Sn.

The display driver 120 may include a scan driver 121, a data driver 122, and a timing controller 125. In addition, the driving signal Dd of the display driver 120 may include the scan signals and the data signals.

The scan driver 121 may supply the scan signals to the scan lines S1 to Sn in response to a scan driver control signal SCS. For example, the scan driver 121 may sequentially supply the scan signals to the scan lines S1 to Sn.

The scan driver 121 may be electrically connected to the scan lines S1 to Sn positioned in the display panel 110 through an additional element (e.g., a circuit board).

In another embodiment, the scan driver 121 may be directly mounted in the display panel 110.

The data driver 122 receives a data driver control signal DCS and the second and third image data items Di2 and Di3 from the timing controller 125 and may generate the data signals.

In addition, when the operation of the image correction unit 150 stops, the data driver 122 receives the first image data Di1 from the timing controller 125 instead of the second image data Di2 and the third image data Di3 and may generate the data signals by using the first image data Di1.

The data driver 122 may supply the generated data signals to the data lines D1 to Dm.

The data driver 122 may be electrically connected to the data lines D1 to Dm positioned in the display panel 110 through an additional element (e.g., a circuit board).

In another embodiment, the data driver 122 may be directly mounted in the display panel 110.

The pixels P that receive the data signals through the data lines D1 to Dm may emit light components with brightness components corresponding to the data signals.

The data driver 122 may receive the second image data Di2 and the third image data Di3 from the timing controller 125 as illustrated in FIG. 6.

In another embodiment, the data driver 122 may receive the second image data Di2 and the third image data Di3 from the image correction unit 150.

Therefore, the data driver 122 may supply the second image data Di2 or the third image data Di3 corrected by the image correction unit 150 to the pixels P so that the display panel 110 may display an image (e.g., the image illustrated in FIGS. 2A to 4B) corresponding to the second image data Di2 or the third image data Di3.

The data driver 122 may be separated from (e.g., external to) the scan driver 121 as illustrated in FIG. 6.

According to another embodiment, the data driver 122 may be integrated with the scan driver 121.

The timing controller 125 may receive the control signal Cs from the host 100.

The timing controller 125 may generate control signals for controlling the scan driver 121 and the data driver 122 based on the control signal Cs.

For example, the control signals may include the scan driver control signal SCS for controlling the scan driver 121 and the data driver control signal DCS for controlling the data driver 122.

Therefore, the timing controller 125 supplies the scan driver control signal SCS to the scan driver 121 and may supply the data driver control signal DCS to the data driver 122.

In addition, the timing controller 125 may receive the second image data Di2 and the third image data Di3 from the image correction unit 150.

At this time, the timing controller 125 converts the second image data Di2 and the third image data Di3 according to a specification of the data driver 122 and may supply the converted second and third image data items Di2 and Di3 to the data driver 122.

The image correction unit 150 may be separated from (e.g., external to) the timing controller 125 as illustrated in FIG. 6.

According to another embodiment, the image correction unit 150 may be integrated with the timing controller 125.

In another embodiment, the timing controller 125 receives the first image data Di1 from the host 100 and may transmit the first image data Di1 to the image correction unit 150.

In this case, the image correction unit 150 does not need to receive the first image data Di1 from the host 100.

Figure 7:
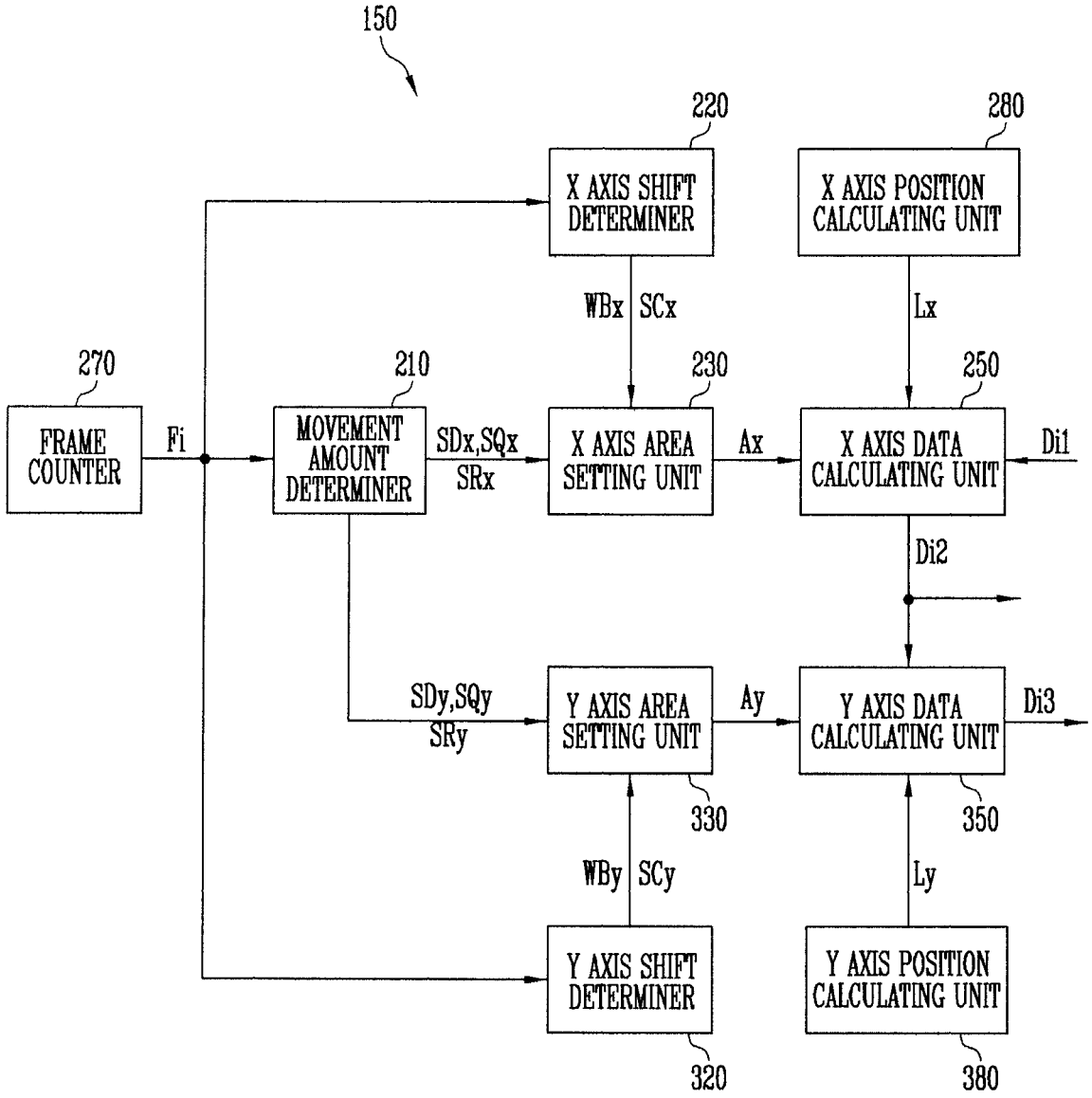
FIG. 7 is a block diagram illustrating the image correction unit according to the embodiment of the present invention.

FIG. 7 is a block diagram illustrating the image correction unit 150 according to the embodiment of the present invention. FIG. 8 illustrates a first look-up table according to an embodiment of the present invention. FIG. 9 illustrates a second look-up table according to an embodiment of the present invention.

Referring to FIG. 7, the image correction unit 150 according to the embodiment of the present invention may include a movement amount determiner 210, an X axis shift determiner 220, an X axis area setting unit (or an X axis area setter) 230, an X axis data calculating unit (or an X axis data calculator) 250, a Y axis shift determiner 320, a Y axis area setting unit (or a Y axis area setter) 330, and a Y axis data calculating unit (or an Y axis data calculator) 350.

In addition, the image correction unit 150 according to the embodiment of the present invention may further include a frame counter 270, an X axis position calculator (or an X axis position calculator) 280, and a Y axis position calculator (or a Y axis position calculator) 380.

The movement amount determiner 210 may determine an X axis movement direction SDx and an X axis movement amount SQx.

In addition, the movement amount determiner 210 may also determine a Y axis movement direction SDy and a Y axis movement amount SQy.

For example, the movement amount determiner 210 may determine the movement directions SDx and SDy and the movement amounts SQx and SQy, with respect to the X and Y axes, corresponding to frame information Fi with reference to the frame information Fi transmitted from the frame counter 270.

For this purpose, the look-up table illustrated in FIG. 8 may be used.

In FIG. 8, the case in which the X axis movement direction SDx is a positive direction (e.g., toward a right side) is displayed as (+) and the case in which the X axis movement direction SDx is a negative direction (e.g., toward a left side) is displayed as (−).

In addition, the case in which the Y axis movement direction SDy is a positive direction (e.g., toward an upper side) is displayed as (+) and the case in which the Y axis movement direction SDy is a negative direction (e.g., toward a lower side) is displayed as (−).

The above is only an example, and a method of expressing the movement directions SDx and SDy may suitably vary.

The movement amount determiner 210 may determine the X and Y axes movement directions SDx and SDy and the X and Y axes movement amounts SQx and SQy corresponding to the frame information Fi with reference to a previously stored first look-up table LUT1.

For example, when the currently supplied first image data Di1 corresponds to a $20^{th}$ frame, the frame counter 270 may set the frame information Fi as "20".

Therefore, the movement amount determiner 210 may set the X axis movement direction SDx and the X axis movement amount SQx as "a left side (−)" and "1" and may set the Y axis movement direction SDy and the Y axis movement amount SQy as "a right side (+)" and "1" in accordance with the first look-up table LUT1 illustrated in FIG. 8.

The frame counter 270 may calculate current frame information Fi. At this time, the frame counter 270 may calculate to which frame the currently supplied first image data Di1 corresponds by using the control signal (e.g., the vertical synchronization signal) supplied from the host 100.

The frame counter 270 may supply the frame information Fi to the movement amount determiner 210.

In addition, the frame counter 270 may supply the frame information Fi to the movement amount determiner 210.

In addition, the frame counter 270 may supply the frame information Fi to the X axis shift determiner 220 and the Y axis shift determiner 320.

The X axis shift determiner 220 may determine an X axis black data amount WBx.

For example, the X axis shift determiner 220 may determine the X axis black data amount WBx corresponding to the frame information Fi with reference to the frame information Fi transmitted from the frame counter 270.

For this purpose, the look-up table LUT2 illustrated in FIG. 9 may be used. That is, the X axis shift determiner 220 may determine the X axis black data amount WBx corresponding to the frame information Fi with reference to the previously stored second look-up table LUT2.

For example, when the currently supplied first image data Di1 corresponds to the $20^{th}$ frame, the frame counter 270 may set the frame information Fi as "20".

Therefore, the X axis shift determiner 220 may set the X axis black data amount WBx as "2" in accordance with the second look-up table LUT2 illustrated in FIG. 9.

The Y axis shift determiner 320 may determine a Y axis black data amount WBy.

For example, the Y axis shift determiner 320 may determine the Y axis black data amount WBy corresponding to the frame information Fi with reference to the frame information Fi transmitted from the frame counter 270.

For example, the Y axis shift determiner 320 may determine the Y axis black data amount WBy corresponding to the frame information Fi with reference to the previously stored look-up table like the X axis shift determiner 220.

A type of the look-up table used by the Y axis shift determiner 320 may be the same as the above-described second look-up table LUT2.

Figure 10:
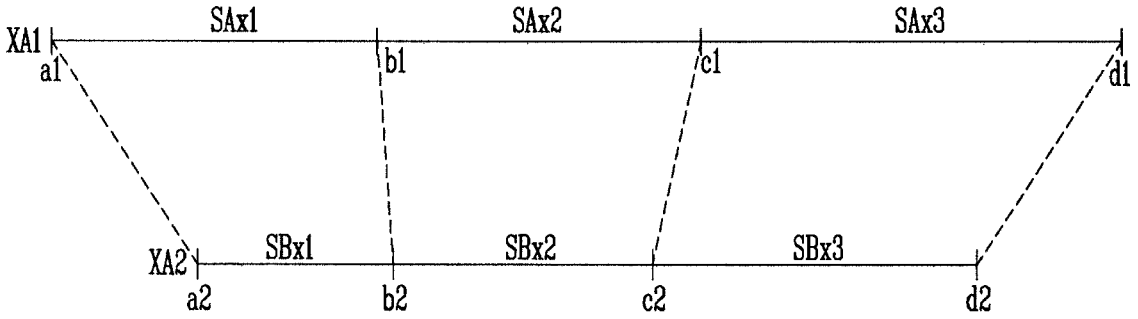
FIG. 10 illustrates an operation of the X axis area setting unit according to an embodiment of the present invention.

FIG. 10 illustrates an operation of the X axis area setting unit 230 according to an embodiment of the present invention.

The X axis area setting unit 230 may set a first X axis area XA1 to be applied to the first image data Di1 and a second X axis area XA2 to be applied to the second image data Di2.

In addition, the X axis area setting unit 230 may transmit set X axis area information Ax to the X axis data calculating unit 250.

For this purpose, the X axis area setting unit 230 may use the X axis movement amount SQx determined by the movement amount determiner 210, the X axis black data amount WBx determined by the X axis shift determiner 220, and an X axis image scaling ratio SCx and an X axis internal scaling ratio SRx that are previously set.

For example, the X axis area setting unit 230 may define the first X axis area XA1 by using the X axis movement amount SQx, the X axis black data amount WBx, and the X axis image scaling ratio SCx and the X axis internal scaling ratio SRx.

In addition, the X axis area setting unit 230 may define the second X axis area XA2 by using the X axis movement amount SQx and the X axis internal scaling ratio SRx.

Referring to FIG. 10, each of the first X axis area XA1 and the second X axis area XA2 may include a plurality of sub-areas. The sub-areas of the first X axis area XA1 correspond to those of the second X axis area XA2.

For example, the first X axis area XA1 may include a first sub-area SAx1, a second sub-area SAx2, and a third sub-area SAx3.

At this time, the second sub-area SAx2 may be positioned between the first sub-area SAx1 and the third sub-area SAx3.

In addition, the second X axis area XA2 may include a first sub-area SBx1, a second sub-area SBx2, and a third sub-area SBx3.

At this time, the second sub-area SBx2 may be positioned between the first sub-area SBx1 and the third sub-area SBx3.

The first sub-area SAx1, the second sub-area SAx2, and the third sub-area SAx3 of the first X axis area XA1 may respectively correspond to the first sub-area SBx1, the second sub-area SBx2, and the third sub-area SBx3 of the second X axis area XA2.

For example, starting points and ending points a1, b1, c1, and d1 of the sub-areas SAx1, SAx2, and SAx3 of the first X axis area XA1 may be defined by the following equations. The following equations are provided as an example, and other embodiments may have various suitable modifications.

At this time, the starting points and ending points a1, b1, c1, and d1 of the respective sub-areas SAx1, SAx2, and SAx3 may be defined by X axis coordinates.

$$a1=0-WBx$$

$$b1=SQx*SRx*SCx-WBx$$

$$c1=Wlx*SCx-SQx*SRx*SCx-WBx$$

$$d1=Wlx*SCx-WBx$$

wherein, a1 is the starting point of the first sub-area SAx1, b1 is the ending point of the first sub-area SAx1 and the starting point of the second sub-area SAx2, c1 is the ending point of the second sub-area SAx2 and the starting point of the third sub-area SAx3, and d1 is the ending point of the third sub-area SAx3. In addition, SQx is the X axis movement amount, SRx is the X axis internal scaling ratio, WBx is the X axis black data amount, and SCx is the X axis image scaling ratio. Wlx is a constant.

At this time, the constant Wlx may be a previously set value and may be determined in consideration of X axis resolution of the display device 10.

For example, when the number of pixels in the X axis direction included in the display device 10 is "4096", the number of pixel data items in the X axis direction of the first image data Di1 is "4096" and the constant Wlx may be set as "4096".

Starting points and ending points a2, b2, c2, and d2 of the sub-areas SBx1, SBx2, and SBx3 of the second X axis area XA2 may be defined by the following equations. The following equations are provided as an example, and other embodiments may have various suitable modifications.

At this time, the starting points and ending points a2, b2, c2, and d2 of the respective sub-areas SBx1, SBx2, and SBx3 may be defined by X axis coordinates.

$$a2=0$$

$$b2=SQx*(SRx-Co1)$$

$$c2=Wlx-SQx*(SRx+Co2)$$

$$d2=Wlx$$

wherein, Co1 and Co2 are constants and may be set as the same value.

In addition, the above equations may be applied when the X axis movement direction SDx is a negative direction (the left side) and may be modified as follows when the X axis movement direction SDx is a positive direction (an upper side).

$$a2=0$$

$$b2=SQx*(SRx+Co1)$$

$$c2=Wlx-SQx*(SRx-Co2)$$

$$d2=Wlx$$

Figure 11:
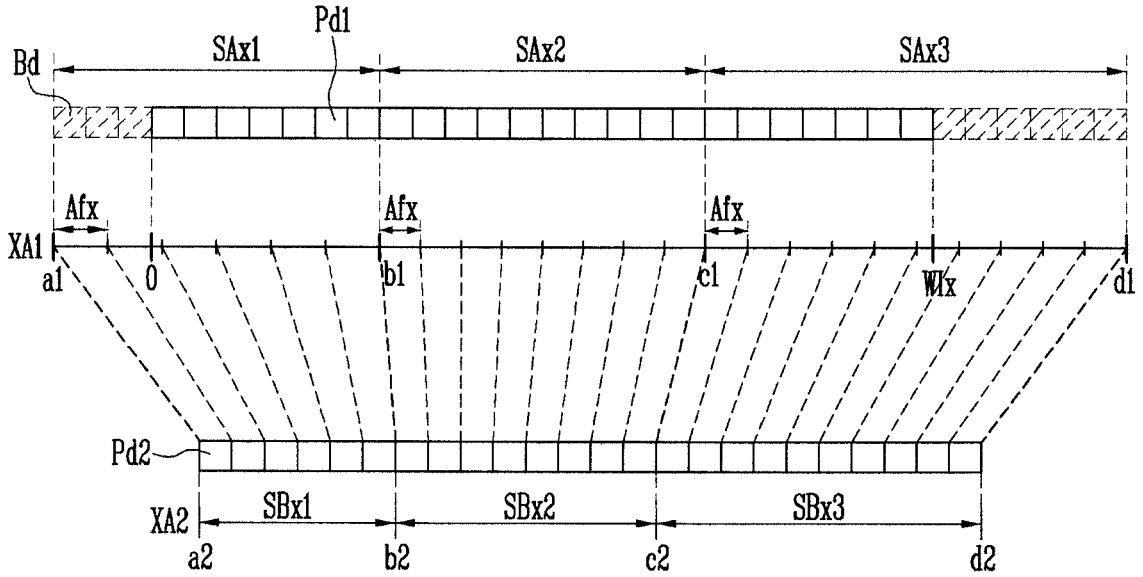
FIG. 11 illustrates an operation of the X axis data calculating unit according to an embodiment of the present invention.
Figure 12:
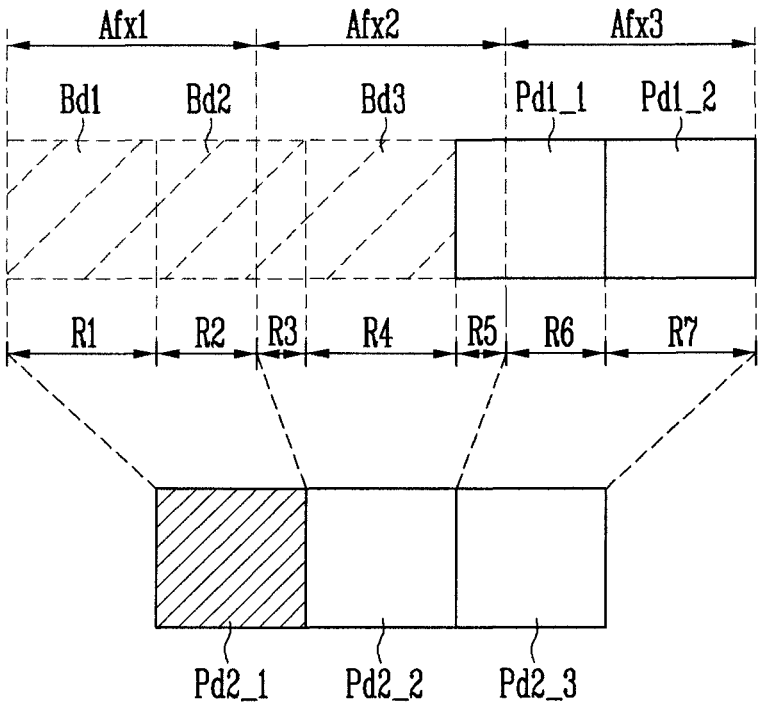
FIG. 12 illustrates the enlarged part of FIG. 11.
Figure 13:
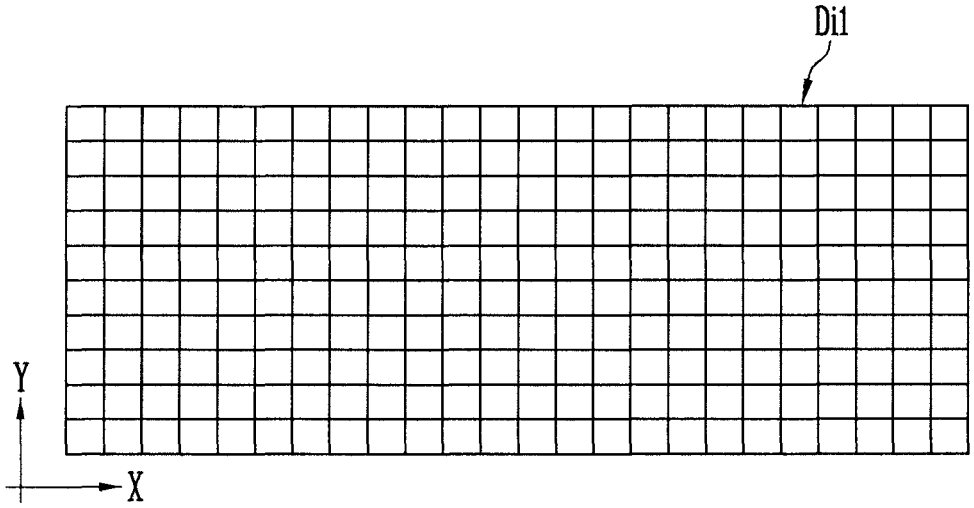
FIG. 13 illustrates first image data according to an embodiment of the present invention.
Figure 14:
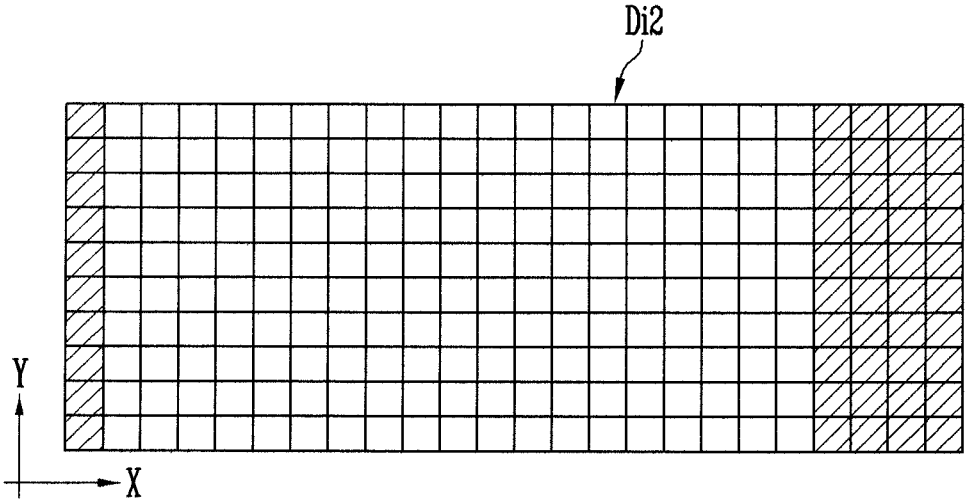
FIG. 14 illustrates second image data according to an embodiment of the present invention.

FIG. 11 illustrates an operation of the X axis data calculating unit 250 according to an embodiment of the present invention. FIG. 12 illustrates the enlarged part of FIG. 11. FIG. 13 illustrates first image data according to an embodiment of the present invention. FIG. 14 illustrates second image data according to an embodiment of the present invention.

In particular, in FIG. 11, for the sake of convenience, a simpler example than real is illustrated and a row of pixel data items Pd1 included in the first image data Di1 and a row of pixel data items Pd2 included in the second image data Di2 are illustrated.

The X axis data calculating unit 250 may calculate the pixel data Pd2 of the second image data Di2 positioned in the respective sub-areas SBx1, SBx2, and SBx3 of the second X axis area XA2 by using the pixel data Pd1 of the first image data Di1 positioned in the respective sub-areas SAx1, SAx2, and SAx3 of the first X axis area XA1.

For this purpose, The X axis data calculating unit 250 may apply the first X axis area XA1 to the first image data Di1 and may apply the second X axis area XA2 to the second image data Di2.

In FIG. 11, it is illustrated that the first X axis area XA1 and the second X axis area XA2 are applied to the first image data Di1 and the second image data Di2.

In particular, in order to apply the first X axis area XA1 to the first image data Di1, a position of the pixel data Pd1 included in the first image data Di1 may be determined (e.g., grasped).

For this purpose, the X axis position calculating unit 280 determines (e.g., grasps) the position of the pixel data Pd1 included in the first image data Di1 and may transmit position information Lx of the pixel data Pd1 to the X axis data calculating unit 250.

Therefore, the X axis data calculating unit 250 may provide coordinates to the pixel data Pd1 included in the first image data Di1 by using the position information Lx transmitted from the X axis position calculating unit 280.

For example, the first left pixel data Pd1 among the row of pixel data items Pd1 may be positioned between 0 and 1 and the second left pixel data Pd1 among the row of pixel data items Pd1 may be positioned between 1 and 2.

The first X axis area XA1 may be set to be larger than a region actually occupied by the pixel data Pd1. It may be assumed that black pixel data Bd exists in a region in which the pixel data Pd1 does not exist.

Each of the sub-areas SAx1, SAx2, and SAx3 of the first X axis area XA1 may include a plurality of fine areas Afx.

At this time, a width of each of the fine areas Afx may be determined by a width of each of the sub-areas SAx1, SAx2, and SAx3 including the corresponding fine area Afx and a width of each of the sub-areas SBx1, SBx2, and SBx3 corresponding to the sub-areas SAx1, SAx2, and SAx3.

For example, the width of each of the fine areas Afx included in the first sub-area SAx1 may be set as a value obtained by dividing a width (e.g., b1 to a1) of the first sub-area SAx1 by a width (e.g., b2 to a2) of the first sub-area SBx1 included in the second X axis area XA2.

In addition, the width of each of the fine areas Afx included in the second sub-area SAx2 may be set as a value obtained by dividing a width (e.g., c1 to b1) of the second sub-area SAx2 by a width (e.g., c2 to b2) of the second sub-area SBx2 included in the first X axis area XA1.

The width of each of the fine areas Afx included in the third sub-area SAx3 may be set as a value obtained by dividing a width (e.g., d1 to c1) of the third sub-area SAx3 by a width (e.g., d2 to c2) of the third sub-area SBx3 included in the first X axis area XA1.

Therefore, the X axis data calculating unit 250 may calculate the pixel data Dd2 of the second image data Di2 corresponding to the fine area Afx by using the at least one pixel data Pd1 included in the fine area Afx.

For example, the X axis data calculating unit 250 may calculate the pixel data Dd2 of the second image data Di2 corresponding to the fine area Afx with reference to a ratio, which corresponds to the at least one pixel data Pd1 being included in the fine area Afx.

A detailed operation of the X axis data calculating unit 250 will be further described with reference to FIG. 12.

For example, third pixel data Pd2_3 of the second image data Di2 may be calculated by using two pixel data items Pd1_1 and Pd1_2 positioned in a fine area Afx3 corresponding thereto.

At this time, because a ratio, which corresponds to the two pixel data items Pd1_1 and Pd1_2 being included in the fine area Afx3, is R6:R7, the pixel data Pd2_3 of the second image data Di2 may be calculated by the following equation.

$$VPd2_3=R6*VPd1_1+R7*VPd1_2$$

wherein, VPd2_3 is a value of the pixel data Pd2_3, VPd1_1 is a value of the pixel data Pd1_1, and VPd1_2 is a value of the pixel data Pd1_2. In addition, R6 is a ratio corresponding to the fine area Afx3 being occupied by the pixel data Pd1_1, and R7 is a ratio corresponding to the fine area Afx3 being occupied by the pixel data Pd1_2.

On the other hand, second pixel data Pd2_2 of the second image data Di2 may be calculated by using three pixel data items Bd2, Bd3, and Pd1_1 positioned in a fine area Afx2 corresponding thereto.

At this time, because a ratio corresponding to the three pixel data items Bd2, Bd3, and Pd1_1 being included in the fine area Afx2 is R3:R4:R5, the pixel data Pd2_2 of the second image data Di2 may be calculated by the following equation.

$$VPd2_2=R3*VBd2+R4*VBd3+R5*VPd1_1$$

wherein, VPd2_2 is a value of the pixel data Pd2_2, VBd2 is a value of black pixel data Bd2, VBd3 is a value of black pixel data Bd3, and VPd1_1 is a value of the pixel data Pd1_1. In addition, R3 is a ratio corresponding to the fine area Afx2 being occupied by the black pixel data Bd2, R4 is a ratio corresponding to the fine area Afx2 being occupied by the black pixel data Bd3, and R5 is a ratio corresponding to the fine area Afx2 being occupied by the pixel data Pd1_1.

At this time, values of the black pixel data items Bd2 and Bd3 may be set as "0". In this case, the value VPd2_2 of the pixel data Pd2_2 may be set as a value obtained by multiplexing R5 by the value VPd1_1 of the pixel data Pd1_1.

In addition, first pixel data Pd2_1 of the second image data Di2 may be calculated by using the two pixel data items Bd1 and Bd2 positioned in a fine area Afx1 corresponding thereto.

At this time, because a ratio corresponding to the two pixel data items Bd1 and Bd2 being included in the fine area Afx1 is R1:R2, the pixel data Pd2_1 of the second image data Di2 may be calculated by the following equation.

$$VPd2_1=R1*VBd1+R2*VBd2$$

wherein, VPd2_1 is a value of the pixel data Pd2_1, VBd1 is a value of the black pixel data Bd1 and VBd2 is a value of the black pixel data Bd2. In addition, R1 is a ratio corresponding to the fine area Afx1 being occupied by the black pixel data Bd1, and R2 is a ratio corresponding to the fine area Afx1 being occupied by the black pixel data Bd2.

At this time, the values of the black pixel data items Bd2 and Bd3 may be set as "0". In this case, the value VPd2_1 of the pixel data Pd2_1 is set as "0" that is equal to the values of the black pixel data items Bd2 and Bd3. Therefore, the pixel data Pd2_1 may be black pixel data Bd that actually displays black.

The X axis data calculating unit 250 may generate the second image data Di2 illustrated in FIG. 14 from the first image data Di1 illustrated in FIG. 13 by performing the above-described operation on the row of pixel data items Pd1 included in the first image data Di1.

At this time, the second image data Di2 may include at least a column of black pixel data Bd at an edge thereof.

For example, as illustrated in FIG. 14, the second image data Di2 includes a column of first left black pixel data items Bd and may include four columns of first right black pixel data items Bd.

The X axis data calculating unit 250 may output the generated second image data Di2. That is, when Y axis correction is not necessary, because the Y axis data calculating unit 350 does not need to operate, the display driver 120 may display a corresponding image by using the second image data Di2.

An operation of converting the second image data Di2 output from the X axis data calculating unit 250 into the third image data Di3 will be described with reference to FIGS. 15 to 18.

Figure 15:
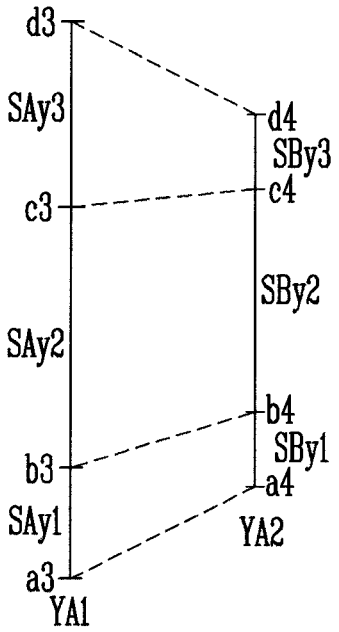
FIG. 15 illustrates an operation of the Y axis area setting unit according to an embodiment of the present invention.

FIG. 15 illustrates an operation of the Y axis area setting unit 330 according to an embodiment of the present invention.

The Y axis area setting unit 330 may set a first Y axis area YA1 to be applied to the second image data Di2 and a second Y axis area YA2 to be applied to the third image data Di3.

In addition, the Y axis area setting unit 330 may transmit set Y axis area information Ay to the Y axis data calculating unit 350.

For this purpose, the Y axis area setting unit 330 may use the Y axis movement amount SQy determined by the movement amount determiner 210, the Y axis black data amount WBy determined by the Y axis shift determiner 320, and a Y axis image scaling ratio SCy and a Y axis internal scaling ratio SRy that are previously set.

For example, the Y axis area setting unit 330 may define the first Y axis area YA1 by using the Y axis movement amount SQy, the Y axis black data amount WBy, and the Y axis image scaling ratio SCy and the Y axis internal scaling ratio SRy.

In addition, the Y axis area setting unit 330 may define the second Y axis area YA2 by using the Y axis movement amount SQy and the Y axis internal scaling ratio SRy.

Referring to FIG. 15, each of the first Y axis area YA1 and the second Y axis area YA2 may include a plurality of sub-areas. The sub-areas of the first Y axis area YA1 correspond to those of the second Y axis area YA2.

For example, the first Y axis area YA1 may include a first sub-area SAy1, a second sub-area SAy2, and a third sub-area SAy3.

At this time, the second sub-area SAy2 may be positioned between the first sub-area SAy1 and the third sub-area SAy3.

In addition, the second Y axis area YA2 may include a first sub-area SBy1, a second sub-area SBy2, and a third sub-area SBy3.

At this time, the second sub-area SBy2 may be positioned between the first sub-area SBy1 and the third sub-area SBy3.

The first sub-area SAy1, the second sub-area SAy2, and the third sub-area SAy3 of the first Y axis area YA1 may respectively correspond to the first sub-area SBy1, the second sub-area SBy2, and the third sub-area SBy3 of the second Y axis area YA2.

For example, starting points and ending points a3, b3, c3, and d3 of the sub-areas SAy1, SAy2, and SAy3 of the first Y axis area YA1 may be defined by the following equations. The following equations are provided as an example and other embodiments may have various suitable modifications.

At this time, the starting points and ending points a3, b3, c3, and d3 of the respective sub-areas SAy1, SAy2, and SAy3 may be defined by Y axis coordinates.

$$a3=0-WBy$$

$$b3=SQy*SRy*SCy-WBy$$

$$c3=Wly*SCy-SQy*SRy*SCy-WBy$$

$$d3=Wly*SCy-WBy$$

wherein, a3 is the starting point of the first sub-area SAy1, b3 is the ending point of the first sub-area SAy1 and the starting point of the second sub-area SAy2, c3 is the ending point of the second sub-area SAy2 and the starting point of the third sub-area SAy3, and d3 is the ending point of the third sub-area SAy3. In addition, SQy is the Y axis movement amount, SRy is the Y axis internal scaling ratio, WBy is the X axis black data amount, and SCy is the Y axis image scaling ratio. Wly is a constant.

At this time, the constant Wly may be a previously set value and may be determined in consideration of Y axis resolution of the display device 10.

For example, when the number of pixels in the Y axis direction included in the display device 10 is "2560", the number of pixel data items in the Y axis direction of the second image data Di2 is "2560" and the constant Wly may be set as "2560".

Starting points and ending points a4, b4, c4, and d4 of the sub-areas SBy1, SBy2, and SBy3 of the second Y axis area YA2 may be defined by the following equations. The following equations are provided as an example and others embodiments may have various suitable modifications.

At this time, the starting points and ending points a4, b4, c4, and d4 of the respective sub-areas SBy1, SBy2, and SBy3 may be defined by Y axis coordinates.

$$a4=0$$

$$b4=SQy*(SRy-Co1)$$

$$c4=Wly-SQy*(SRy+Co2)$$

$$d4=Wly$$

wherein, Co1 and Co2 are constants and may be set as the same value.

In addition, the above equations may be applied when the Y axis movement direction SDy is a negative direction (e.g., a lower side) and may be modified as follows when the Y axis movement direction SDy is a positive direction (e.g., an upper side).

$$a4=0$$

$$b4=SQr(SRy+Co1)$$

$$c4=Wly-SQy*(SRy-Co3)$$

$$d4=Wly$$

Figure 16:
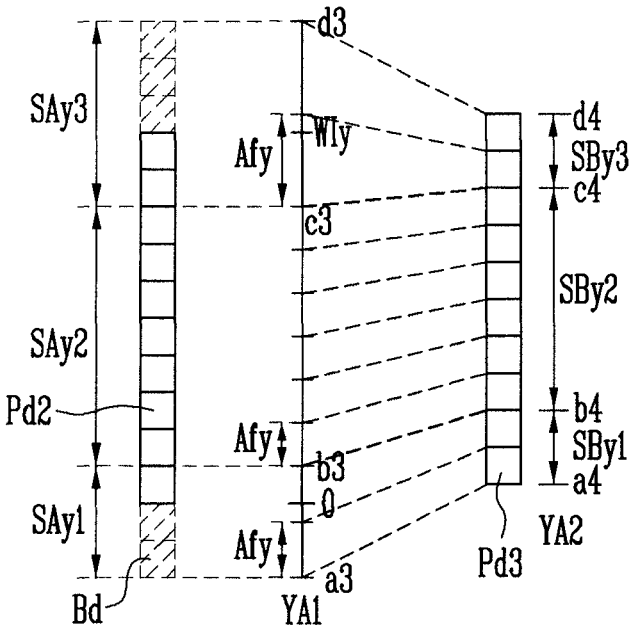
FIG. 16 illustrates an operation of the Y axis data calculating unit according to an embodiment of the present invention.
Figure 17:
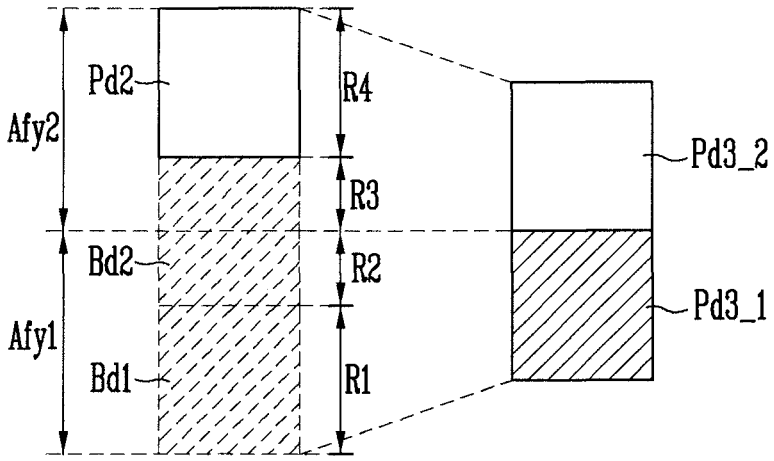
FIG. 17 illustrates an enlarged part of FIG. 16.
Figure 18:
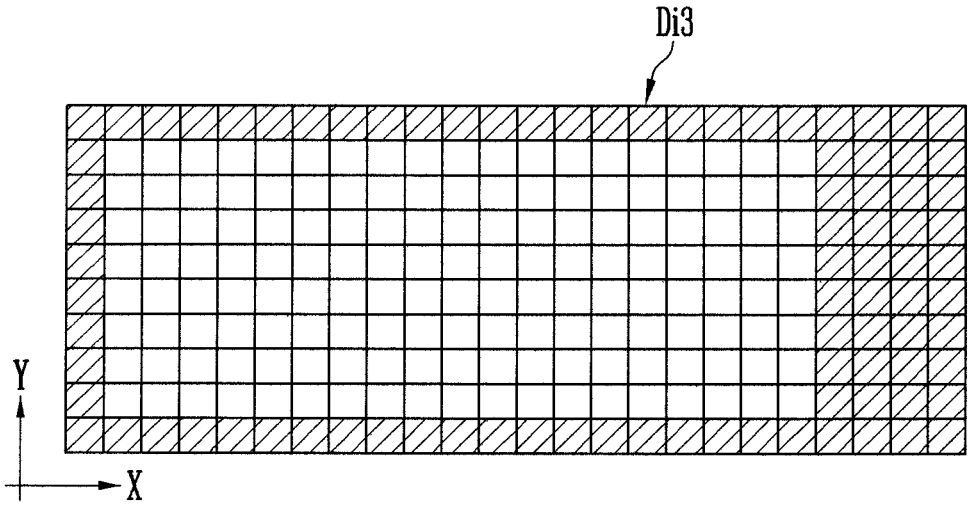
FIG. 18 illustrates third image data according to an embodiment of the present invention.

FIG. 16 illustrates an operation of the Y axis data calculating unit 350 according to an embodiment of the present invention. FIG. 17 illustrates the enlarged part of FIG. 16. FIG. 18 illustrates third image data according to an embodiment of the present invention.

In particular, in FIG. 16, for the sake of convenience, a simpler example than real is illustrated and a column of pixel data items Pd2 included in the second image data Di2 and a column of pixel data items Pd3 included in the third image data Di3 are illustrated.

The Y axis data calculating unit 350 may calculate the pixel data Pd3 of the third image data Di3 positioned in the respective sub-areas SBy1, SBy2, and SBy3 of the second Y axis area YA2 by using the pixel data Pd2 of the second image data Di2 positioned in the respective sub-areas SAy1, SAy2, and SAy3 of the first Y axis area YA1.

For this purpose, The Y axis data calculating unit 350 may apply the first Y axis area YA1 to the second image data Di2 and may apply the second Y axis area YA2 to the third image data Di3.

In FIG. 16, it is illustrated that the first Y axis area YA1 and the second Y axis area YA2 are applied to the second image data Di2 and the third image data Di3.

In particular, in order to apply the first Y axis area YA1 to the second image data Di2, a position of the pixel data Pd2 included in the second image data Di2 may be determined (e.g., grasped).

For this purpose, the Y axis position calculating unit 380 determines (e.g., grasps) the position of the pixel data Pd2 included in the second image data Di2 and may transmit position information Ly of the pixel data Pd2 to the Y axis data calculating unit 350.

Therefore, the Y axis data calculating unit 350 may provide coordinates to the pixel data Pd2 included in the second image data Di2 by using the position information Ly transmitted from the Y axis position calculating unit 380.

For example, the first lower pixel data Pd2 among the column of pixel data items Pd2 may be positioned between 0 and 1 and the second lower pixel data Pd2 among the column of pixel data items Pd2 may be positioned between 1 and 2.

The first Y axis area YA1 may be set to be larger than a region actually occupied by the pixel data Pd2. It may be assumed that black pixel data Bd exists in a region in which the pixel data Pd2 does not exist.

Each of the sub-areas SAy1, SAy2, and SAy3 of the first Y axis area YA1 may include a plurality of fine areas Afy.

At this time, a width of each of the fine areas Afy may be determined by a width of each of the sub-areas SAy1, SAy2, and SAy3 including the corresponding fine area Afy and a width of each of the sub-areas SBy1, SBy2, and SBy3 corresponding to the sub-areas SAy1, SAy2, and SAy3.

For example, the width of each of the fine areas Afy included in the first sub-area SAy1 may be set as a value obtained by dividing a width (e.g., b3 to a3) of the first sub-area SAy1 by a width (e.g., b4 to a4) of the first sub-area SBy1 included in the second Y axis area YA2.

In addition, the width of each of the fine areas Afy included in the second sub-area SAy2 may be set as a value obtained by dividing a width (e.g., c3 to b3) of the second sub-area SAy2 by a width (e.g., c4 to b4) of the second sub-area SBy2 included in the second Y axis area YA2.

The width of each of the fine areas Afy included in the third sub-area SAy3 may be set as a value obtained by dividing a width (e.g., d3 to c3) of the third sub-area SAy3 by a width (e.g., d4 to c4) of the third sub-area SBy3 included in the second Y axis area YA2.

Therefore, the Y axis data calculating unit 350 may calculate the pixel data Dd3 of the third image data Di3 corresponding to the fine area Afy by using the at least one pixel data Pd2 included in the fine area Afy.

For example, the Y axis data calculating unit 350 may calculate the pixel data Dd3 of the third image data Di3 corresponding to the fine area Afy with reference to a ratio corresponding to the at least one pixel data Pd2 being included in the fine area Afy.

A detailed operation of the Y axis data calculating unit 350 will be further described with reference to FIG. 17.

For example, first pixel data Pd3_1 of the third image data Di3 may be calculated by using two pixel data items Bd1 and Bd2 positioned in a fine area Afy1 corresponding thereto.

At this time, because a ratio corresponding to the two pixel data items Bd1 and Bd2 being included in the fine area Afy1 is R1:R2, the pixel data Pd3_1 of the third image data Di3 may be calculated by the following equation.

$$VPd3_1=R1*VBd1+R2*VBd2$$

wherein, VPd3_1 is a value of the pixel data Pd3_1, VBd1 is a value of the black pixel data Bd1, and VBd2 is a value of the black pixel data Bd2. In addition, R1 is a ratio corresponding to the fine area Afy1 being occupied by the black pixel data Bd1, and R2 is a ratio corresponding to the fine area Afy1 being occupied by the black pixel data Bd2.

At this time, the values of the black pixel data items Bd1 and Bd2 may be set as "0". In this case, the value VPd3_1 of the pixel data Pd3_1 is set as "0" that is equal to the values of the black pixel data items Bd1 and Bd2. Therefore, the pixel data Pd3_1 may be black pixel data Bd that actually displays black.

On the other hand, second pixel data Pd3_2 of the third image data Di3 may be calculated by using two pixel data items Bd2 and Pd2 positioned in a fine area Afy2 corresponding thereto.

At this time, because a ratio corresponding to two pixel data items Bd2 and Pd2 being included in the fine area Afy2 is R3:R4, the pixel data Pd3_2 of the third image data Di3 may be calculated by the following equation.

$$VPd3_2=R3*VBd2+R4*VPd2$$

wherein, VPd3_2 is a value of the pixel data Pd3_2, VBd2 is a value of the black pixel data Bd2, and VPd2 is a value of the pixel data Pd2. In addition, R3 is a corresponding to which the fine area Afy2 being occupied by the black pixel data Bd2, and R4 is a ratio corresponding to the fine area Afy2 being occupied by the pixel data Pd2.

At this time, a value of the black pixel data Bd2 may be set as "0". In this case, the value VPd3_2 of the pixel data Pd3_2 may be set as a value obtained by multiplying R4 by the value VPd2 of the pixel data Pd2.

The Y axis data calculating unit 350 may generate the third image data Di3 illustrated in FIG. 18 by performing the above-described operation on the column of pixel data items Pd2 included in the second image data Di2.

At this time, the third image data Di3 may include at least a row of black pixel data Bd at an edge thereof.

For example, as illustrated in FIG. 18, the third image data Di3 includes a row of uppermost black pixel data items Bd and may include a column of lowermost black pixel data items Bd.

The Y axis data calculating unit 350 may output the generated third image data Di3. Therefore, the display driver 120 may display a corresponding image by using the third image data Di3.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "lower", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on" or "connected to" another element or layer, it can be directly on or connected to the other element or layer, or one or more intervening elements or layers may be present. When an element or layer is referred to as being "directly on" or "directly connected to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The image correction unit and the display device (collectively referred to as the "device") and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the device may be formed on one integrated circuit (IC) chip or on separate IC chips. Further, the various components of the device may be implemented on a flexible printed circuit film, a tape carrier package (TCP), a printed circuit board (PCB), or formed on a same substrate. Further, the various components of the device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various suitable changes in form and details may be made without departing from the spirit and scope of the present invention as set forth in the following claims, and equivalents thereof.

What is claimed is:

1. An image corrector comprising:

a frame counter configured to calculate frame information corresponding to a frame number of first image data based on a control signal;

corresponding to a frame number of first image data based on a control signal;

a movement amount determiner configured to determine an X axis movement direction and an X axis movement amount corresponding to the frame information and with reference to a first look-up table, the first look-up table mapping the frame information to the X axis movement direction and the X axis movement amount;

an X axis shift determiner configured to determine an X axis black data amount corresponding to the frame information and with reference to a second look-up table, the second look-up table mapping the frame information to the X axis black data amount;

an X axis area setter configured to set a first X axis area and a second X axis area each comprising a plurality of sub-areas such that the sub-areas of the first X axis area correspond to those of the second X axis area by using the X axis movement amount, the X axis black data amount, an X axis image scaling ratio, and an X axis internal scaling ratio; and an X axis data calculator configured to calculate pixel data of second image data in each of the sub-areas of the second X axis area by using pixel data of first image data in each of the sub-areas of the first X axis area.

2. The image corrector of claim 1, wherein the second image data comprises at least a column of black pixel data at an edge thereof.

3. The image corrector of claim 1, wherein the first X axis area comprises a first sub-area, a third sub-area, and a second sub-area between the first sub-area and the third sub-area, and wherein each of the first sub-area, the second sub-area, and the third sub-area of the first X axis area comprises a plurality of fine areas.

4. The image corrector of claim 3, wherein the X axis data calculator is configured to calculate pixel data of second image data corresponding to a fine area of the first X axis area by using at least one pixel data in the fine area of the first X axis area.

5. The image corrector of claim 4, wherein the X axis data calculator is configured to calculate pixel data of second image data corresponding to a fine area of the first X axis area with reference to a ratio corresponding to at least one pixel data in the fine area of the first X axis area.

6. The image corrector of claim 1, wherein the movement amount determiner is further configured to determine a Y axis movement direction and a Y axis movement amount corresponding to the frame information and with reference to the first look-up table.

7. The image corrector of claim 6, further comprising:

a Y axis shift determiner configured to determine a Y axis black data amount;

a Y axis area setter configured to set a first Y axis area and a second Y axis area by using the Y axis movement amount, the Y axis black data amount, a Y axis image scaling ratio, and a Y axis internal scaling ratio, each of the first and second Y axis areas including a plurality of sub-areas such that the sub-areas of the first Y axis area correspond to those of the second Y axis area; and a Y axis data calculator configured to calculate pixel data of third image data in each of the sub-areas of the second Y axis area by using pixel data of the second image data in each of the sub-areas of the first Y axis area.

8. The image corrector of claim 7, wherein the third image data comprises at least a row of black pixel data at an edge thereof.

9. The image corrector of claim 7, wherein the first Y axis area comprises a first sub-area, a third sub-area, and a second sub-area between the first sub-area and the third sub-area, and wherein each of the first sub-area, the second sub-area, and the third sub-area of the first Y axis area comprises a plurality of fine areas.

10. The image corrector of claim 9, wherein the Y axis data calculator is configured to calculate pixel data of third image data corresponding to a fine area of the first Y axis area by using at least one pixel data in the fine area of the first Y axis area.

11. The image corrector of claim 10, wherein the Y axis data calculator is further configured to calculate pixel data of third image data corresponding to a fine area of the first Y axis area with reference to a ratio corresponding to at least one pixel data in the fine area of the first Y axis area.

12. A display device comprising:

a display panel;

an image corrector configured to correct first image data; and a display driver configured to control the display panel such that an image corresponding to image data corrected by the image corrector is displayed on the display panel by using the corrected first image data, wherein the image corrector comprises:

a frame counter configured to calculate frame information corresponding to a frame number of first image data based on a control signal;

a movement amount determiner configured to determine an X axis movement direction and an X axis movement amount corresponding to the frame information and with reference to a first look-up table, the first look-up table mapping the frame information to the X axis movement direction and the X axis movement amount;

an X axis shift determiner configured to determine an X axis black data amount corresponding to the frame information and with reference to a second look-up table, the second look-up table mapping the frame information to the X axis black data amount;

an X axis area setter configured to set a first X axis area and a second X axis area each comprising a plurality of sub-areas such that the sub-areas of the first X axis area correspond to those of the second X axis area by using the X axis movement amount, the X axis black data amount, an X axis image scaling ratio, and an X axis internal scaling ratio; and an X axis data calculator configured to calculate pixel data of second image data in each of the sub-areas of the second X axis area by using pixel data of the first image data in each of the sub-areas of the first X axis area.

13. The display device of claim 12, wherein the second image data comprises at least a column of black pixel data at an edge thereof.

14. The display device of claim 12, wherein the first X axis area comprises a first sub-area, a third sub-area, and a second sub-area between the first sub-area and the third sub-area, and wherein each of the first sub-area, the second sub-area, and the third sub-area of the first X axis area comprises a plurality of fine areas.

15. The display device of claim 14, wherein the X axis data calculator is configured to calculate pixel data of second image data corresponding to a fine area of the first X axis area by using at least one pixel data in the fine area of the first X axis area.

16. The display device of claim 15, wherein the X axis data calculator is configured to calculate pixel data of second image data corresponding to a fine area of the first X axis area with reference to a ratio corresponding to at least one pixel data in the fine area of the first X axis area.

17. The display device of claim 12, wherein the movement amount determiner is further configured to determine a Y axis movement direction and a Y axis movement amount corresponding to the frame information and with reference to the first look-up table.

18. The display device of claim 17, further comprising:

a Y axis shift determiner configured to determine a Y axis black data amount;

a Y axis area setter configured to set a first Y axis area and a second Y axis area each comprising a plurality of sub-areas such that the sub-areas of the first Y axis area correspond to those of the second Y axis area by using the Y axis movement amount, the Y axis black data amount, a Y axis image scaling ratio, and a Y axis internal scaling ratio; and a Y axis data calculator configured to calculate pixel data of third image data in each of the sub-areas of the second Y axis area by using pixel data of the second image data in each of the sub-areas of the first Y axis area.

19. The display device of claim 18, wherein the third image data comprises at least a row of black pixel data at an edge thereof.

20. The display device of claim 18, wherein the first Y axis area comprises a first sub-area, a third sub-area, and a second sub-area between the first sub-area and the third sub-area, and wherein each of the first sub-area, the second sub-area, and the third sub-area of the first Y axis area comprises a plurality of fine areas.

21. The display device of claim 20, wherein the Y axis data calculator is configured to calculate pixel data of third image data corresponding to a fine area of the first Y axis area by using at least one pixel data in the fine area of the first Y axis area.

22. The display device of claim 21, wherein the Y axis data calculator is configured to calculate pixel data of third image data corresponding to a fine area of the first Y axis area with reference to a ratio corresponding to at least one pixel data in the fine area of the first Y axis area.

23. The image corrector of claim 1, wherein the control signal is a vertical synchronization signal received from a host external to the image corrector.

24. The image corrector of claim 7, wherein the Y axis shift determiner configured to determine the Y axis black data amount corresponding to the frame information with reference to the second look-up table.

25. The display device of claim 12, wherein the control signal is a vertical synchronization signal received from a host external to the image corrector.

26. The image corrector of claim 18, wherein the Y axis shift determiner configured to determine the Y axis black data amount corresponding to the frame information with reference to the second look-up table.

* * * * *